US005168944A

United States Patent [19]

Andersson

[11] Patent Number: 5,168,944

[45] Date of Patent: Dec. 8, 1992

[54] TELESCOPICALLY EXTENSIBLE DRILL

[75] Inventor: Lars-Erik Andersson, Gällivare, Sweden

[73] Assignee: Gruvprodukter I Gallivare AB, Gallivare, Sweden

[21] Appl. No.: 688,493

[22] PCT Filed: Dec. 8, 1989

[86] PCT No.: PCT/SE89/00720

§ 371 Date: Jun. 6, 1991

§ 102(e) Date: Jun. 6, 1991

[87] PCT Pub. No.: WO90/06416

PCT Pub. Date: Jun. 14, 1990

[30] Foreign Application Priority Data

Dec. 8, 1988 [SE] Sweden ..... 8804445

[51] Int. Cl.[5] ..... E21B 17/07

[52] U.S. Cl. ..... 175/321; 286/302

[58] Field of Search ..... 175/321, 300, 246, 248; 285/302

[56] References Cited

U.S. PATENT DOCUMENTS

| | | | |
|---|---|---|---|
| 1,635,289 | 7/1927 | Scott | 175/300 |
| 1,672,321 | 6/1928 | Kammerdiner | 175/300 |
| 3,194,330 | 7/1965 | Ware et al. | 175/321 |
| 3,255,612 | 6/1966 | Mayer et al. | 175/321 X |
| 4,004,643 | 1/1977 | Newman | 175/321 |
| 4,113,038 | 9/1978 | Clark | 175/321 X |
| 4,133,395 | 1/1979 | Schmidt | 175/321 X |

FOREIGN PATENT DOCUMENTS

| | | |
|---|---|---|
| 1190746 | 10/1959 | France . |
| 989028 | 1/1983 | U.S.S.R. . |

*Primary Examiner*—Stephen J. Novosad

*Attorney, Agent, or Firm*—Burns, Doan, Swecker & Mathis

[57] ABSTRACT

A telescopically extensible drill comprises a drill barrel, a drill bit connected to the barrel, and a drill rod which can be displaced between two longitudinally spaced positions in relation to the drill barrel, and secured in either of those positions. The drill can thus be extended in length without having to splice additional barrels or rods to the drill.

10 Claims, 3 Drawing Sheets

TELESCOPICALLY EXTENSIBLE DRILL

BACKGROUND OF THE INVENTION

The present invention relates to a telescopically extensible drill.

Extensible drills are used, for instance, for rock drilling purposes, e.g. for drifting tunnels. The drills are used to drill holes intended for receiving explosive charges for instance. When applying known techniques, the drilling machine or drilling equipment used is constructed for advancement along a so-called drill guide-bar or feed bar. Such rock drills will preferably operate in the manner of hammer drills, i.e. drills which subject the drill to axially-directed impacts while the drill rotates. With known techniques, the length of the drill is extended during a drilling operation, by joining the drill to one or more drill rods, so that the requisite depth of the drill hole can be achieved. This is effected, for instance, by placing a rack of drill rods adjacent the drill guide-bar. The work of splicing or otherwise joining the drill-rod(s) to the drill is normally automated or effected with the aid of mechanical devices. Unfortunately, this requires the provision of relatively complicated peripheral equipment. The drill-rod magazine with associated equipment is also bulky and space consuming.

OBJECTS AND SUMMARY OF INVENTION

The object of the present invention is to provide a telescopically extensible drill which will eliminate the need for splicing or joining drill-rods to the drill which has a drill member in which a drill rod is longitudinally displaceable between two different drilling positions to effect an extension of the drill. This object is achieved by a drill. The extensibility of the inventive telescopic drill eliminates all need of said rod-splicing equipment.

BRIEF DESCRIPTION OF THE DRAWINGS

The invention will now be described in more detail with reference to exemplifying embodiments thereof illustrated in the accompanying drawings, in which.

DETAILED DESCRIPTION OF A PREFERRED EMBODIMENT OF THE INVENTION

Figure 1:
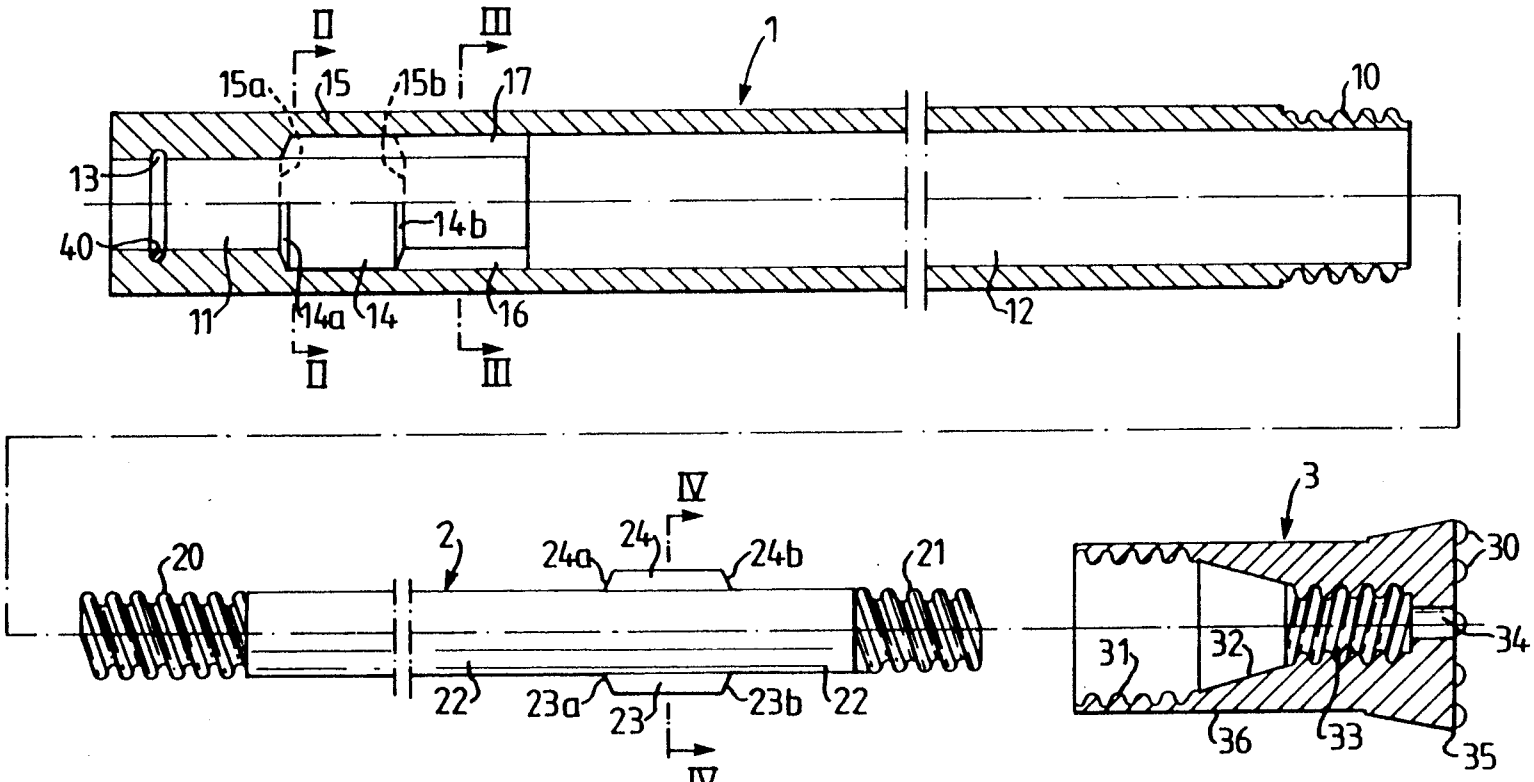
FIG. 1 is a partly cut-away longitudinal view illustrating the inventive drill in a dismantled state.

As illustrated in FIG. 1, the inventive, telescopic, extensible drill comprises an outer drill barrel 1, an inner drill rod 2 and a drill bit 3.

Figure 3:
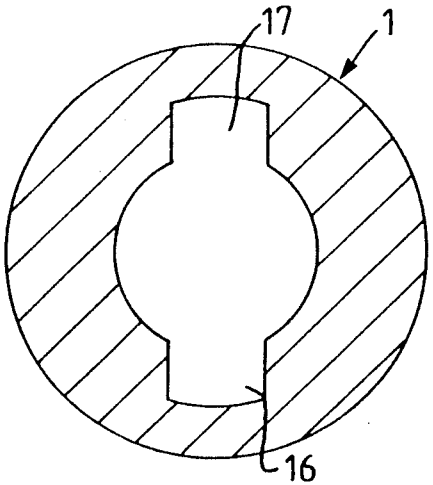
FIG. 3 is a sectional view taken through the drill barrel on the line III—III in FIG. 1.
Figure 2:
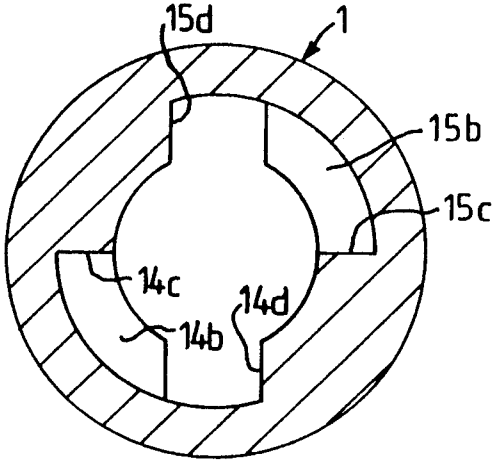
FIG. 2 is a sectional view through the drill barrel, taken on the line II—II in FIG. 1.

The forward end of the drill barrel 1 has an external screw thread 10. The drill barrel 1 also has a first axially extending centre bore 11 and a second axially extending centre bore 12, said bores being of circular cross-section and the bore 12 having a larger diameter than the bore 11. The bore 11 has provided therein a circular groove 13 which is intended to receive a seal 40. The bore 11 is also configured with two recesses 14 and 15, as illustrated in FIGS. 1 and 2. The recess 14 has longitudinally spaced end surfaces 14*a* and 14*b* respectively, and respective edge parts 14*c* and 14*d*. The recess 15 has longitudinally spaced end surfaces 15*a* and 15*b* respectively, and edge parts 15*c* and 15*d*. Disposed within a part of the bore 11 are two longitudinally extending recesses in the form of grooves 16 and 17 respectively, which extend between the recesses 14, 15 and the central bore 12. The configuration of the grooves 16 and 17 is shown in FIGS. 1 and 3.

Figure 4:
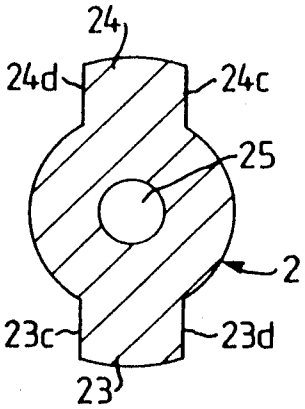
FIG. 4 is a sectional view of a drill rod taken on the line IV—IV in FIG. 1.

The rear end of the drill rod 2 has a screw thread 20 by means of which the drill rod can be fitted to the drilling machine, whereas the forward end of the drill rod has a screw thread 21 for fitting the drill to the drill bit 3. The drill rod 2 has a cylindrical part 22 of circular cross-section, on which there are provided two radial projections or shoulders 23 and 24, as illustrated in FIGS. 1 and 4. The diametrical extension of the shoulders corresponds essentially to the diameter of the round centre bore 12 of the drill barrel 1. The shoulders 23 and 24 also have a dimension which corresponds to the dimension of the grooves 16 and 17 in the barrel 1. The diameter of the rod-part 22 corresponds essentially to the diameter of the central bore 11. The length extension of the shoulders 23 and 24 corresponds to the length extension of the recesses 14 and 15. The shoulder 23 has two end surfaces 23*a* and 23*b* and two edge parts 23*c* and 23*d*. Similarly, the shoulder 24 has two end surfaces 24*a*and 24*b* and two edge parts 24*c* and 24*d*. The drill rod 2 has extending axially therethrough a hole 25 for rinsing fluid.

The drill bit 3 preferably includes a plurality of drill buttons or drill inserts 30. The drill bit 3 also includes an internal screw thread 31, a conical junction surface 32, an internal screw thread 33, and one or more rinsing-fluid holes 34. The tip end 35 of the drill bit 3 preferably has a larger outer diameter than the rearward part 36 of said bit, the outer diameter of this rearward part preferably coinciding with the outer diameter of the drill barrel 1.

Figure 5:
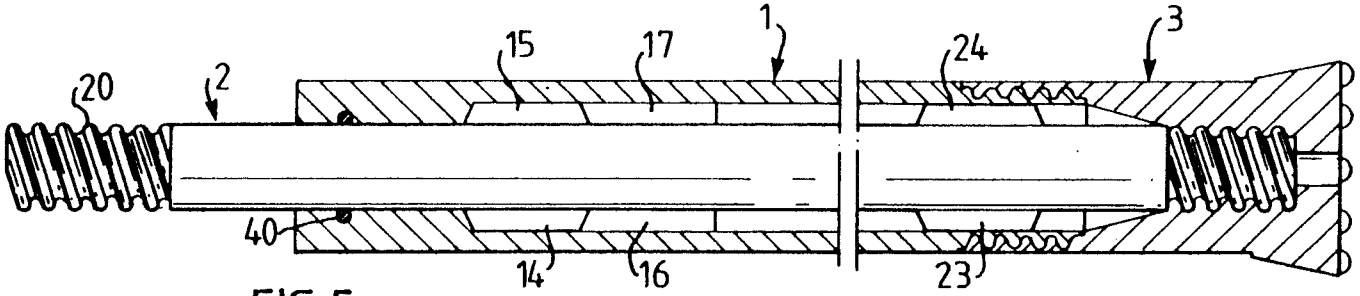
FIG. 5 is a schematic view of the inventive drill in its assembled, operational state.

FIG. 5 illustrates the inventive telescopically extensible drill in its assembled state and in a retracted, functional state, in which state the drill rod 2 has been inserted into the barrel 1 and the drill bit 3 has been firmly screwed to the barrel 1, by mutual engagement between the screw threads 10 and 31, and the drill-rod 2 has been screwed firmly to the drill bit 3, by mutual engagement of the screw threads 21 and 33. In this state of the drill, the shoulders 23 and 24 on the drill rod 2 are located in the second centre bore 12 of the barrel 1.

The inventive drill illustrated in FIG. 5 is fitted to an appropriate drilling machine (not shown), with the aid of the rearwardly located screw thread 20 on the drill-rod 2. In an initial drilling stage, the inventive drill is used to drill a hole to a depth corresponding essentially to the length of the drill barrel 1.

The outer diameter of the drill barrel 1 will preferably be substantially equal to the outer diameter of the tip end 35 of the bit 3, whereby the drill is guided so as to obtain a straight drill hole. Such guiding of the drill is extremely important, and since guiding of the drill is effected by the drill barrel 1, it is possible to use a thinner drill-rod 2 without deviating from the intended direction of the drill hole in a later drilling stage.

Figure 6:
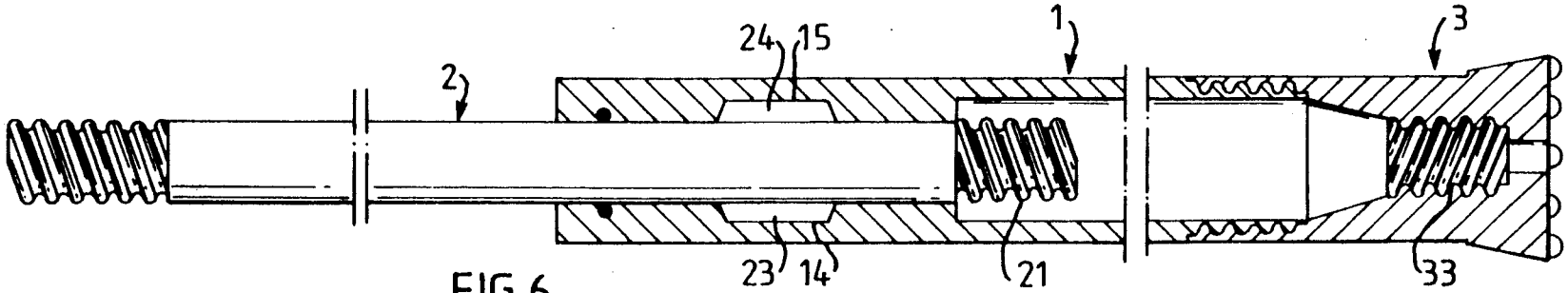
FIG. 6 is a schematic view which illustrates the drill in a telescopically extended state, i.e. its extended functional state.

In the next stage, the drill-barrel 1 is temporarily fixated with the aid, for instance, of a so-called drill holder (not shown), whereafter the drill-rod 2 is unscrewed from the drill bit 3, by rotating the rod with the aid of the drilling machine. The drilling machine is then returned along the drill guide-bar, so that the shoulders 23 and 24 of the inwardly located drill rod 2 will pass through the grooves 16 and 17 and so that the shoulders 23 and 24 are able to enter the recesses 14 and 15 in the drill barrel. When the whole of the shoulders 23 and 24 are located in the recesses 14 and 15 and the drill-rod 2 has thus been extended to its maximum from the barrel 1, the drill rod 2 is rotated relative to the outer barrel 1, such as to bring the edge parts 23*c* and 24*c* of the shoulders 23 and 24 into abutment with the edge parts 14*c* and 15*c* of the recesses 14 and 15, see FIGS. 2 and 4. As a result, the inventive telescopically extensible drill has now been positioned and fixated in its extended functional position, whereafter drilling of said hole can be continued, by freeing the barrel 1 from the drill holder and permitting the drill to continue drilling through the rock for instance, in a known manner, until the depths of the hole being drilled corresponds substantially to the sum of the length of the barrel 1 and the free length of the drill-rod 2 extending from said barrel, as illustrated in FIG. 6.

When the hole has been drilled to the depth required with the aid of the inventive drill in its extended functional state, the following steps are taken. The drilling machine is returned along the drill bar, so as to bring the rearward end of the barrel 1 outside the drill hole. The barrel is then gripped by means of the drill holder and the drill rod 2 is rotated relative to the barrel 1, with the aid of the drilling machine, so as to bring the shoulders 23 and 24 of the drill rod into register with the grooves 16 and 17 in the barrel 1. The drilling machine is then advanced in a manner to withdraw the telescopic drill to its retracted, functional state, and during the final instance of this retraction movement the drill-rod 2 is also rotated relative to the barrel 1, so as to screw the thread 21 at the forward end of the drill rod 2 into the screw thread 33 of the drill bit 3. The drill holder is thereafter manouvered out of engagement with the drill barrel 1, and the drill can now be used to drill a further hole in the aforedescribed manner.

A rinsing or washing liquid, for instance, is delivered to the drilling area during a drilling operation through the drilling machine and through the central hole 25 of the drill rod 2, this liquid exiting from the telescopically extensible drill through the rinsing-water hole or holes provided in the drill bit 3. This liquid is intended to bind together the dust, drill cuttings, produces when drilling a hole.

The seal 40 prevents the leakage of rinsing liquid between the barrel 1 and the drill rod 2.

The shoulders 23, 24 and/or the grooves 16, 17 will preferably be provided with climbing chamfers or chamfered lead-ins (not shown) so as to enable the shoulders 23 and 24 on the drill rod 2 to be readily guided into the grooves 16 and 17 of the drill barrel 1, when extending the drill.

The shoulders 23,24 need not necessarily be two in number, and the number of shoulders provided may be varied from one shoulder and upwards. The number of grooves 16, 17 and recesses 14,15 provided will at least correspond to the number of shoulders present.

The screw threads 10, 21, 31, 33 may also be replaced, for instance, with bayonet fittings or conical joints. It will also be understood that the screw thread 20 can be omitted or replaced by some other appropriate means, since this end of the drill rod 2 is dependent on the design of the drilling machine used. The particular construction of the inventive drill enables vibrations, impacts and knocks to be transferred effectively between the drilling machine and the drill bit.

It will also be understood that the inventive, telescopically extensible drill is not contingent on any particular design of drilling machine and neither is it restricted to rock drilling, since the inventive drill can, of course, be used for drilling holes in many other connections.

Consequently, the invention is not restricted to the illustrated and described embodiments, since the illustrated embodiment can be changed and modified in various way within the scope of the following claims.

I claim:

1. A telescopically extensible drill comprising a drilling member and a drill rod connected thereto, said drilling member comprising a barrel and a drill bit connected to a longitudinal front end of said barrel, said drill rod provided with means at a rear end thereof for securing said drill rod to a driving tool, said drill rod being displaceable longitudinally relative to said drill barrel between first and second positions, said drill rod including attaching means for attaching said drill rod to said drilling member in each of said two positions, said attaching means comprises a screw thread for attaching said drill rod to said drilling member in one of said positions, and at least one radial projection for attaching said drill rod to said drilling member in the other of said positions.

2. A drill according to claim 1, wherein said barrel comprises at least one internal recess for receiving said at least one radial projection.

3. A drill according to claim 2, wherein said drill bit comprises a screw thread for engaging said screw thread on said drill rod.

4. A drill according to claim 1, wherein said drill bit comprises a screw thread for engaging said screw thread on said drill rod.

5. A telescopically extensible drill for use in drifting tunnels, comprising a drill barrel; a drill bit connected to said drill barrel; and a drill rod displaceable between a retracted drilling state and an extended drilling state; said drill-rod including an external screw thread which, in said retracted drilling state of said drill rod, is in engagement with an internal screw thread on said drill bit; said drill rod including two shoulders which, in said extended drilling state of said drill rod, are in engagement with two internal recesses, respectively, disposed in said drill barrel.

6. A telescopically extensible drill according to claim 5, wherein said drill barrel includes a first central bore whose diameter corresponds to a diameter of said drill rod, and a larger second central bore whose diameter corresponds to a diameter defined by said shoulders on said drill rod; said drill barrel comprising two grooves which are provided between said recesses and said second central bore so that said drill rod can be displaced to said extended drilling state upon unscrewing of said drill rod from said drill bit, whereupon said drill rod is extended and said shoulders pass through said grooves and into said recesses.

7. A telescopically extensible drill according to claim 6, wherein said drill barrel and said drill bit are mutually connected by means of a screw joint.

8. A telescopically extensible drill according to claim 5, wherein said drill barrel and said drill bit are mutually connected by means of a screw joint.

9. A telescopically extensible drill according to claim 8, wherein said recesses are arranged within a portion of said drill barrel which contains said first central bore.

10. A telescopically extensible drill according to claim 9, wherein said recesses present end surfaces which are operative to locate said shoulders in a longitudinal direction of the drill when the rotational position of said shoulders deviates from the positioning of said grooves.

* * * * *